US011267145B2

(12) United States Patent
Horowitz et al.

(10) Patent No.: US 11,267,145 B2
(45) Date of Patent: Mar. 8, 2022

(54) HAIR CUTTING APPLIANCE

(71) Applicant: KONINKLIJKE PHILIPS N.V., Eindhoven (NL)

(72) Inventors: Dmitri Horowitz, Leeuwarden (NL); Marcus Cornelis Petrelli, Groningen (NL); Ivar Bosma, Oranjewoud (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 0 days.

(21) Appl. No.: 17/262,772

(22) PCT Filed: Aug. 6, 2019

(86) PCT No.: PCT/EP2019/071127

§ 371 (c)(1),
(2) Date: Jan. 25, 2021

(87) PCT Pub. No.: WO2020/030642

PCT Pub. Date: Feb. 13, 2020

(65) Prior Publication Data

US 2021/0308885 A1 Oct. 7, 2021

(30) Foreign Application Priority Data

Aug. 7, 2018 (EP) ..... 18187636
Sep. 21, 2018 (EP) ..... 18196049

(51) Int. Cl.
*B26B 19/14* (2006.01)
*B26B 19/28* (2006.01)

(52) U.S. Cl.
CPC ..... *B26B 19/145* (2013.01); *B26B 19/28* (2013.01)

(58) Field of Classification Search
CPC ..... B26B 19/145; B26B 19/28; B26B 19/14
See application file for complete search history.

(56) References Cited

U.S. PATENT DOCUMENTS 2,280,052 A * 4/1942 Bahr ..... B26B 19/14 30/43.6
4,077,120 A * 3/1978 Herrick ..... B26B 19/145 30/43.5

(Continued)

FOREIGN PATENT DOCUMENTS

CN 2629930 Y 8/2004
EP 1175972 1/2002

(Continued)

OTHER PUBLICATIONS

International Search Report and Written Opinion dated Oct. 18, 2019 for International Application No. PCT/EP2019/071127 Filed Aug. 6, 2019.

*Primary Examiner* — Sean M Michalski

(57) ABSTRACT

A hair cutting appliance comprises an external cutting member and an internal cutting member arranged rotatable to the external cutting member for cutting hair. The internal cutting member is driven via a first coupling element by a drive spindle (24) rotatable about an axis of rotation (35) and having a first spindle part (26) arranged to be driven by a drive, and a second spindle part (30) arranged to be coupled to the internal cutting member, the first and second spindle parts (26, 30) being displaceable relative to each other in an axial direction parallel to the axis of rotation (35); wherein the second spindle part (30) comprises a second coupling element (34) which is coupled to the first coupling element for transmitting, during operation, a driving torque about the axis of rotation (35) from the drive spindle (24, 24*a*) to the internal cutting member; wherein one of the first and second spindle parts (26, 30) comprises an abutment element (36) and the other of the first and second spindle parts (26, 30) comprises an abutment surface (38) arranged to cooperate with the abutment element (36) for transmitting, during operation, the driving torque from the first spindle part (26)

(Continued)

to the second spindle part (30); wherein the abutment surface (38) is arranged at an angle α relative to a tangential direction relative to the axis of rotation (35), wherein $0° < \alpha < 90°$ such that a transmission of the driving torque from the first spindle part (26) to the second spindle part (30) via the abutment element (36) and the abutment surface (38) results in a force exerted by the first spindle part (26) on the second spindle part (28) having a component parallel to the axis of rotation (35) and directed towards the internal cutting member, wherein the first and second coupling elements are configured to transmit the component from the second spindle part (30) to the second coupling element (34).

13 Claims, 9 Drawing Sheets

(56) References Cited

U.S. PATENT DOCUMENTS 5,283,953 A 2/1994 Ikuta
5,794,514 A * 8/1998 Pecorari ..... F04B 1/124 417/269
6,145,200 A * 11/2000 Jorna ..... B26B 19/141 30/346.51
6,460,252 B1 * 10/2002 Nakano ..... B26B 19/141 30/346.51
7,422,433 B2 * 9/2008 Carron ..... A61C 17/005 433/125
7,669,336 B2 * 3/2010 Kawafune ..... B26B 19/3853 30/43.4
7,698,819 B2 4/2010 De Wit
7,845,078 B2 * 12/2010 Shimizu ..... B26B 19/143 30/43.5
8,296,954 B2 * 10/2012 Schneider ..... B26B 19/3853 30/43.4
9,009,978 B2 * 4/2015 Schneider ..... B26B 19/14 30/43.4
9,027,251 B2 * 5/2015 Schmitt ..... B26B 19/146 30/41
9,266,246 B2 * 2/2016 Schmitt ..... B26B 19/141
10,654,182 B2 * 5/2020 Meijer ..... B26B 19/14
10,850,408 B2 * 12/2020 Peters ..... B26B 19/141
2002/0083591 A1 * 7/2002 Geertsma ..... B26B 19/141 30/43.6
2003/0019107 A1 * 1/2003 Visman ..... B26B 19/141 30/43.6
2007/0084059 A1 * 4/2007 Hannan ..... B26B 19/14 30/43.5

FOREIGN PATENT DOCUMENTS

WO 2008/010139 1/2008
WO 2018138172 8/2018

* cited by examiner

HAIR CUTTING APPLIANCE

CROSS REFERENCE TO RELATED APPLICATIONS

This application is the U.S. National Phase application under 35 U.S.C. § 371 of International Application No. PCT/EP2019/071127 filed Aug. 6, 2019, which claims the benefit of European Patent Application Number 18196049.3 filed Sep. 21, 2018 and European Patent Application Number 18187636.8 filed Aug. 7, 2018. These applications are hereby incorporated by reference herein.

FIELD OF THE INVENTION

The present invention relates to a hair cutting device that can be used as a shaver or a hair trimmer.

BACKGROUND OF THE INVENTION

Rotary electric shavers commonly use coupling spindles for transferring the rotary power from the drive to the cutting system. Apart from that there are several secondary functions, one of which is exercising axial force onto the cutting elements. This is the closing force, by which the cutting elements are held to the shaving caps. Too little closing force allows a cutting gap to occur between the cutting elements and the shaving cap, with faulty cutting and hair pulling as a result. On the other hand, increasing the closing force also increases friction, whereby noise, wear, energy loss, and as a consequence of this, shortened battery life result. Coupling spindles are commonly designed to exercise an approximately constant axial force (cutting pre-tension) that remains within a functionally acceptable window of operation.

From U.S. Pat. No. 5,283,953 a rotary drive shaver is known including an outer shearing foil supported on a head frame and an inner cutting unit holder having a center axis and carrying a plurality of inner blades in hair shearing engagement with the outer shearing foil. The inner cutting unit holder is operatively connected to a rotary drive shaft of an electric motor so as to be driven thereby to rotate about the center axis. The outer shearing foil is held movable in the direction of the center axis relative to the head frame, while the inner cutting unit holder is movable along the center axis relative to the rotary drive shaft so as to be floatingly supported thereby. The outer shearing foil is connected to the inner cutting unit holder by means of a pin extending along the center axis such that the outer shearing foil and the inner cutting unit holder are movable together along the center axis relative to the head frame as well as the rotary drive shaft. Accordingly the contact pressure and thus the closing force between the inner blades and the outer shearing foil can be kept substantially at a constant level irrespective of the relative movement of the outer shearing foil to the head frame.

From U.S. Pat. No. 7,698,819 B1 a rotary shaving apparatus is known, wherein in the cutting unit there is integrated a mechanism for adapting the closing force depending on the torque transmitted from the cutting unit during the cutting operation. To achieve this, within the cutting unit there is arranged a cam cooperating with a ramp surface on a carrier that is directed obliquely towards the coupling member viewed in a direction opposed to the drive direction, such that the cam is guided along the sloping ramp surface. To achieve this, the driving surface and the driven surface cooperating therewith have mutually corresponding helical shapes.

Although such an arrangement may basically help to improve shaving performance, since the closing force can be varied depending on the torque exerted on the cutting unit, this design suffers from several drawbacks.

Since the self-adaptive mechanism with the cooperating helical surfaces is contained within the cutting unit, it is unavoidably exposed to pollution from hair particles, skin flakes, and skin grease. Also it is confined to a very small space. The pollution can build up, and can obstruct the movement of the segments, may cause mechanical contact and transmission of forces in places or directions that were not intended in the design. Due to this, the mechanism can get stuck, or work not as intended. With increasing pollution, friction may build up and may impair the self-adaptive characteristic. In order to work, self-locking due to friction should be avoided, which, however, is not always ensured. In the known shaver the cutting unit blades are rigidly attached to the self-adaptive mechanism. This makes the angle of the contact force on the helical ramps dependent on the angle of the cutting force, which is in reality highly variable. As a result of the varying contact force, the friction forces vary. Excessive cutting forces can contribute to uncontrolled self-locking.

In the known cutting unit the axial forces that are exercised by the cutting unit onto the cap are transferred directly from the helical ramp surfaces which are at some distance from the central axis. In theory, the contact forces should be distributed equally among the three ramp surfaces, and the resulting force should be in the center. In reality however, as the geometry is never perfect, not all surfaces will remain in contact and transfer force simultaneously. As a result, the location of the resulting axial force will be eccentric and variable. This can negatively affect control over the mechanical working of the cutting unit in the beard cutting process, and the life of the cutting system. Also the contact forces on individual ramp surfaces vary, and by this the magnitude of the friction forces, contributing to potential self-locking.

In the known cutting unit further irregularities in the geometry of the ramp surfaces and its counter-geometry will cause parasitic force components in radial directions. As the ramp surfaces are rigidly part of the cutting unit, these radial forces will be transferred to the areas, where the cutting unit is in contact with the cap. Also this can negatively affect control over the mechanical working of the cutting unit, the beard cutting process, and the life of the cutting system. Further in the known cutting unit the segments containing the helical ramps and the interfacing geometry are axially aligned by design and are fixed in this position. This makes the mechanism less likely to recover from a friction-induced self arrest situation.

SUMMARY OF THE INVENTION

In view of this it is an object of the present invention to provide an improved hair cutting appliance that may be configured as a shaver or as a trimmer that delivers a variable axial force in response to the torque that is exercised on the cutting unit. It shall at least overcome some of the drawbacks mentioned above.

In a first aspect of the present invention this object is solved by a hair cutting appliance, comprising:

a support structure accommodating a drive system;

at least one cutting unit supported by the support structure and comprising an external cutting member having a plurality of hair entry openings, and an internal cutting member rotatable relative to the external cutting member; and at least one drive spindle rotatable about an axis of rotation and having a first spindle part arranged to be driven by the drive system and a second spindle part arranged to be coupled to the internal cutting member, the first and second spindle parts being displaceable relative to each other in an axial direction parallel to the axis of rotation;

wherein the internal cutting member comprises a plurality of cutting elements, a first coupling element, and a carrier carrying the cutting elements and the first coupling element;

wherein the second spindle part comprises a second coupling element which is coupled to the first coupling element for transmitting, during operation, a driving torque about the axis of rotation from the drive spindle to the internal cutting member; and wherein one of the first and second spindle parts comprises an abutment element and the other of the first and second spindle parts comprises an abutment surface arranged to cooperate with the abutment element for transmitting, during operation, the driving torque from the first spindle part to the second spindle part;

wherein the abutment surface is arranged at an angle $\alpha$ relative to a line extending parallel to the axis of rotation, wherein $0° < \alpha < 90°$ such that a transmission of the driving torque from the first spindle part to the second spindle part via the abutment element and the abutment surface results in a force exerted by the first spindle part on the second spindle part having a component parallel to the axis of rotation and directed towards the internal cutting member, wherein the first and second coupling elements are configured to transmit said component from the second spindle part to the internal cutting member.

According to the invention the drive spindle (corresponding to the coupling spindle mentioned above) comprises a mechanism that delivers a variable axial force in response to the torque that is exercised on the drive spindle. Thus the closing force is automatically and instantaneously adapted to optimize for cutting performance or wear and energy loss, as the user's situation of the moment requires.

The mechanism can be realized by a simple modification in geometry of existing drive spindles, without the addition of parts.

Since the self-adaptive mechanism is accommodated in an area that is separated from the hair chamber in which the beard's hairs are cut and collected, there is no problem with respect to pollution from hair particles, skin flakes, skin grease etc. The self-adaptive mechanism can be arranged, for example, in a separate compartment, or outside of the cutting unit. Thereby the mechanism remains unaffected by pollution.

Further pollution by hair particles, skin flakes, and skin grease does not affect the friction properties of the self-adaptive mechanism. Thus there is little potential for self-locking.

In the typical shaver the cutting unit typically consists of a metal part, with a plastic molded insert. During manufacturing the metal blades of the cutting unit are sharpened, and grinding particles are released. These particles stick onto the cutting units plastic insert, and may affect the friction properties in the prior art mechanism that is located within the cutting unit. According to the invention the mechanism will not be affected by the sharpening process, as the spindle parts are manufactured separately.

According to the invention the cutting unit and the self-adaptive mechanism are mechanically separated, whereby it is avoided, that varying contact forces between the cutting unit blade and the user's face lead to a variation of friction forces and that excessive cutting forces can lead to uncontrolled self-locking.

Further, according to the invention the axial force from the self-adaptive mechanism is always exercised to the approximate center of the cutting unit. Irregular contact between the abutment element and the corresponding slanted abutment surface will not affect the location of the axial force onto the cutting unit.

Any radial forces originating from the self-adaptive mechanism are not transmitted to the cutting unit.

According to the invention in addition in the drive spindle the axes of the segments are not rigidly aligned, but move about in a continuous motion while they are rotating. As a result a continuous complex motion between the abutment element and the associated abutment surface will occur, and the contact angles will continuously vary in multiple directions. This makes occurrences of self-arrest unlikely to persist. Continuous complex motion of the abutment element over the associated abutment surface will also rub dirt away that could affect the friction properties and contribute to self-locking.

Further according to the invention the drive spindle is of telescopic nature. This property is relevant in combination with shaver designs, in which the cap-and-cutting unit-system resides in contour-following sections, while the driving mechanism resides in a stationary section. In these designs, the cutting units are driven by a telescopic spindle that contracts and expands with the contour-following movements. With a shaver according to the invention contour-following movements will occur during usage, and the abutment element will move up and down along with the associated slanted abutment surface of the drive spindle. By this, dirt that could affect the working of the self-adaptive mechanism is continuously rubbed off.

According to a further embodiment of the invention the coupling formed by the first and second coupling elements may be configured for transmitting torque and for transmitting force in the axial direction of the drive spindle, but not to transmit any other mechanical loads.

This may typically be obtained by a coupling as known from US 2003/0019107 A1 which is herein fully incorporated by reference. Accordingly the contact force on the abutment surface is not dependent on the angle of the cutting force, whereby there is no variation in friction forces. Self-locking by excessive cutting forces is avoided. Forces acting on the cutting unit—other than in the axial direction of the spindle—are not transferred to the self-adaptive mechanism.

According to a still further embodiment of the invention the second coupling element is releasably coupleable to the first coupling element. As a result, the second spindle part is releasably coupleable to the internal cutting member. This fascilitates disassembly of the hair cutting appliance, for example when cleaning the hair cutting appliance.

According to another exemplary embodiment the abutment surface extends helically relative to the axis of rotation.

A helical orientation of the abutment surface is the most obvious design to obtain a force component parallel to the axis of rotation and directed towards the internal cutting member, although other configurations are possible.

According to another exemplary embodiment of the invention the abutment element comprises a boss.

In accordance with another exemplary embodiment the drive spindle comprises a mechanical spring arranged to bias the second spindle part relative to the first spindle part in a direction towards the internal cutting member.

The spring provides an additional axial force that acts as an offset to the closing force resulting from the interaction between the abutment elements and the abutment surfaces. Together these forces provide the closing force onto the cutting elements. The spring ensures extension of the spindle and a minimum closing force.

According to another exemplary embodiment the first spindle part comprises a cavity, and the second spindle part is partially received in said cavity and displaceably guided by said cavity so as to be displaceable relative to the first spindle part in the axial direction.

This leads to a simple design.

According to another exemplary embodiment, the mechanical spring is arranged in the cavity for exerting a biasing force on the second spindle part directed towards the internal cutting member.

This leads to a simple and reliable design and an easy assembly.

The angle $\alpha$ at which the abutment surface is arranged may be used as a design parameter to set the ratio between the torque and the axial force. The offset of the axial force can be tuned by the properties of the enclosed spring.

The angle $\alpha$ is greater than 0° and smaller than 90°. Preferably, the angle is $\alpha \geq 3°$, preferably $\alpha \geq 5°$, preferably $\alpha \geq 20°$.

On the other hand the angle $\alpha$ preferably is $\alpha \leq 87°$, preferably $\alpha \leq 85°$, preferably $\alpha \leq 70°$.

In one embodiment the angle $\alpha$ is between 20° and 70°.

Friction forces between the first spindle part or driven part and the second spindle part or driving part have been neglected so far, since such friction forces are inherent in any kind of drive spindle consisting of two parts movable with respect to each other. The angle $\alpha$ should have a minimum value so that dynamic friction forces are overcome so that there will be a continuous movement of the first spindle part with respect to the second spindle part under pressure exerted by the cutting unit. The friction is dynamic due to the angle between the first and second spindle parts. The critical minimum angle $\alpha$ can be derived from sin ($\alpha$)=friction coefficient. The minimum angle $\alpha$ to overcome dynamic friction forces is estimated to be on the order of 3° to 8°.

According to another exemplary embodiment the angle varies along an axial extension of the drive spindle. In combination with a contour-following mechanism, thus the relationship between the torque and the closing force can then be varied by the position of the shaving head. To this end the cutting unit is moveably suspended relative to the support structure by means of a suspension structure such that, as a result of a motion of the cutting unit relative to the support structure allowed by the suspension structure, the first coupling element is displaced in the axial direction whereby the first and second spindle parts are displaced relative to each other in the axial direction, and wherein the angle $\alpha$ of the abutment surface varies in the axial direction.

In accordance with another exemplary embodiment the cutting unit comprises a supporting member for supporting the external cutting member, and wherein the suspension structure comprises a pivot structure pivotally connecting the supporting member to the support structure.

In accordance with another exemplary embodiment of the invention, the hair cutting appliance comprises at least two cutting units and at least two drive spindles as described with respect to any of the embodiments of the hair cutting appliance here before, wherein each of the at least two drive spindles is arranged to be couplable to a respective one of the at least two cutting units.

According to another embodiment of the invention the hair cutting appliance may be used as a hair trimmer. The cutting unit driven by the drive spindle according to the invention may be used with a decreased closing force when running idle (not cutting any hair). Thereby, overheating may be prevented.

According to still another embodiment, the mechanical spring can be omitted. In that case, the drive spindle is permanently attached to the axle of the cutting system. The closing force will then be exercised by the torque-induced mechanism alone. Some minimum friction should be provided to ensure a minimum torque in operation and a closing of the cutting system.

According to another aspect of the invention there is disclosed a hair cutting device comprising a main housing accommodating an actuator, and further comprising a hair cutting appliance as described here before, wherein the support structure is releasably coupled to the main housing, and wherein the actuator is arranged to drive the drive system during operation of the hair cutting device when the hair cutting appliance is coupled to the main housing.

Preferred embodiments of the invention are defined in the dependent claims. It shall be understood that the claims may not only be used in the given order but may also be used in different combinations or independently without departing from the scope of the invention as disclosed herein.

BRIEF DESCRIPTION OF THE DRAWINGS

These and other aspects of the invention will be apparent from and elucidated with reference to the embodiment(s) described hereinafter. In the following drawings

DETAILED DESCRIPTION OF THE INVENTION

Figure 1:
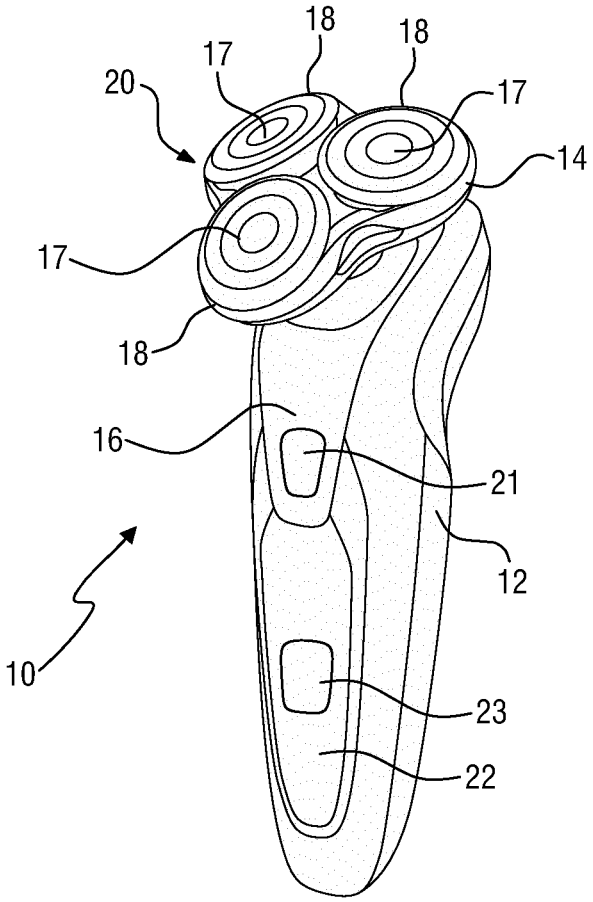
FIG. 1 shows a perspective view of a hair cutting appliance according to the invention configured as a shaver.

FIG. 1 shows a perspective top view of a hair cutting device 10 that is configured as a shaver. The hair cutting device 10 comprises an elongated main housing 12 and a hair cutting appliance configured as a shaving unit 20 arranged at a top end of the main housing 12. The shaving unit 20 comprises a cutting head 14 with three cutting units 17 that are arranged in a somewhat triangular fashion.

In the main housing 12, a drive 16 is accommodated (not illustrated herein in much detail). The drive 16 is configured to operate and actuate the shaving unit 20 by means of at least one drive spindle to be explained hereinafter with reference to the following drawings. At the main housing 12, there may be provided further components of the hair cutting device 10, such as operator controls, an on-off switch 21, an external setting pad 23, a battery, a socket for an electric cable, and the like.

The shaving unit 20 in total can be removed from the hair cutting device 10 which includes the main housing 12, the drive 16, the electronic control etc. The hair cutting appliance or shaving unit 20 is a replacement part that may be replaced, if necessary.

As this arrangement is basically known in the art and does not form part of the invention, it will not be explained here in further detail.

Figure 2:
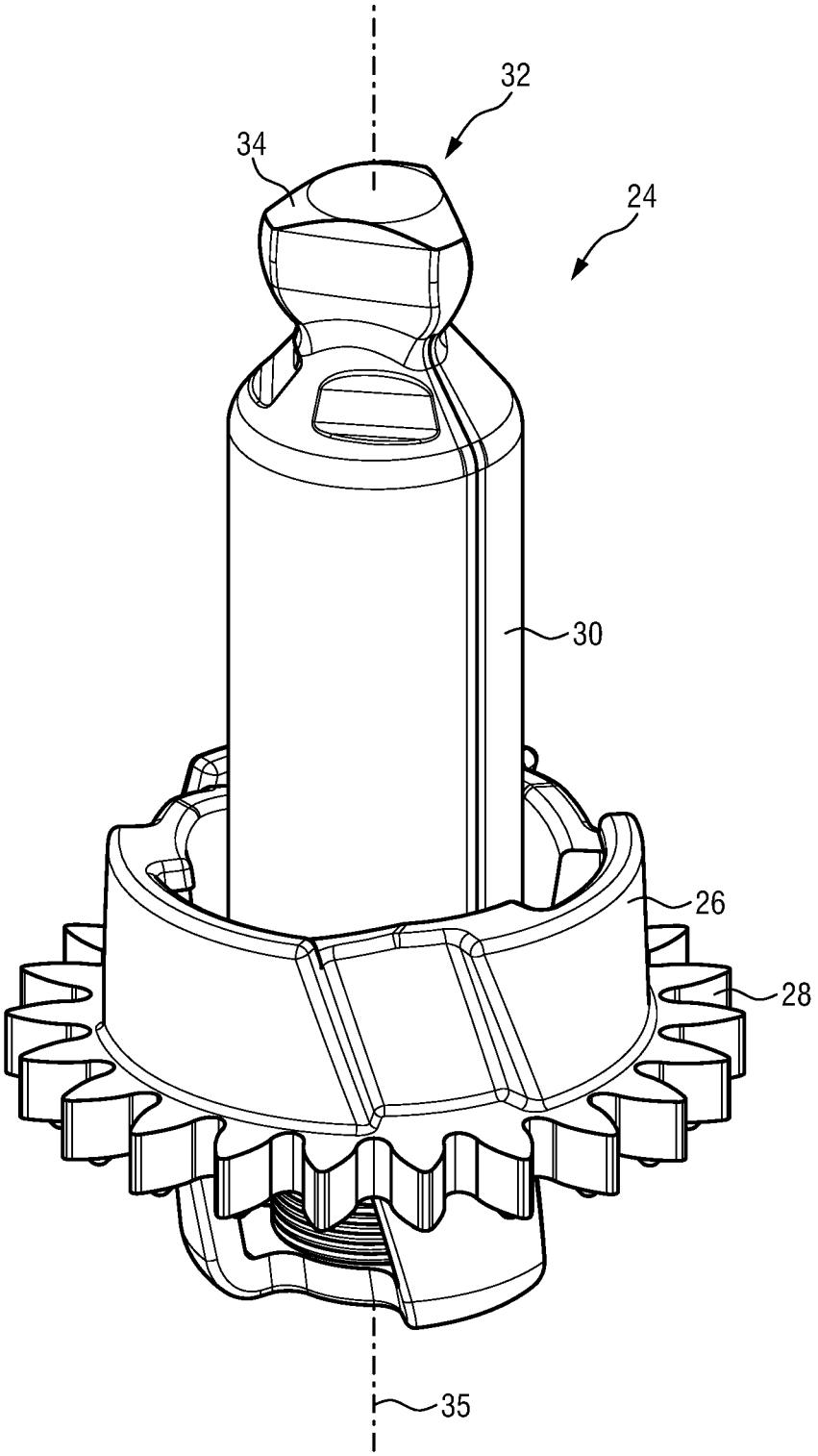
FIG. 2 shows an enlarged perspective view of a drive spindle used in the hair cutting appliance according to FIG. 1.

According to FIG. 2 the appliance 10 comprises a drive spindle 24. The drive spindle 24 transfers a rotary motion of the drive 16 to the cutting unit 17. The drive spindle 24 comprises a second part (driven part) 30 of cylindrical configuration that is received with its lower end within a first part (driving part) 26. The first part of the drive spindle 24 comprises an outer toothing 28 to be driven by a corresponding toothing (not shown) of the drive 16. At the top end of the second part 30 there is provided a coupling designated in total with 32 from which only the second coupling element 34 of a somewhat triangular shape with rounded sides is shown that cooperates with a corresponding cavity (first coupling element) arranged at the cutting unit 17.

Such a coupling is described in detail in US 2003/0019107 A1 which is fully incorporated by reference herewith. This type of coupling is configured to transmit torque, and to transmit force only in the axial direction of the drive spindle 24, but to transmit not any other mechanical loads.

The drive spindle 24 is rotated by the drive 16 about its axis of rotation 35. The first part 26 and the second part 30 are arranged axially displaceable with respect to each other. According to the invention the drive spindle 24 is configured to provide a self-adaptive closing force onto the cutting unit 17 as will be explained in the following.

When the shaving unit 20 encounters beard hairs, the torque will increase, and the closing force will instantaneously increase as well. With heavier beards, the torque will increase more, and the closing force accordingly. This will improve cutting performance with heavier beards while unnecessary skin irritation with lighter beards is avoided. When the shaver is running idle, the torque will decrease, and the closing force will be decreased accordingly. Thereby friction, wear, energy loss, and noise are reduced, and battery life is extended.

The respective forces transmitted in such a system are explained later with respect to the drawings according to FIGS. 4 and 5.

Figure 3:
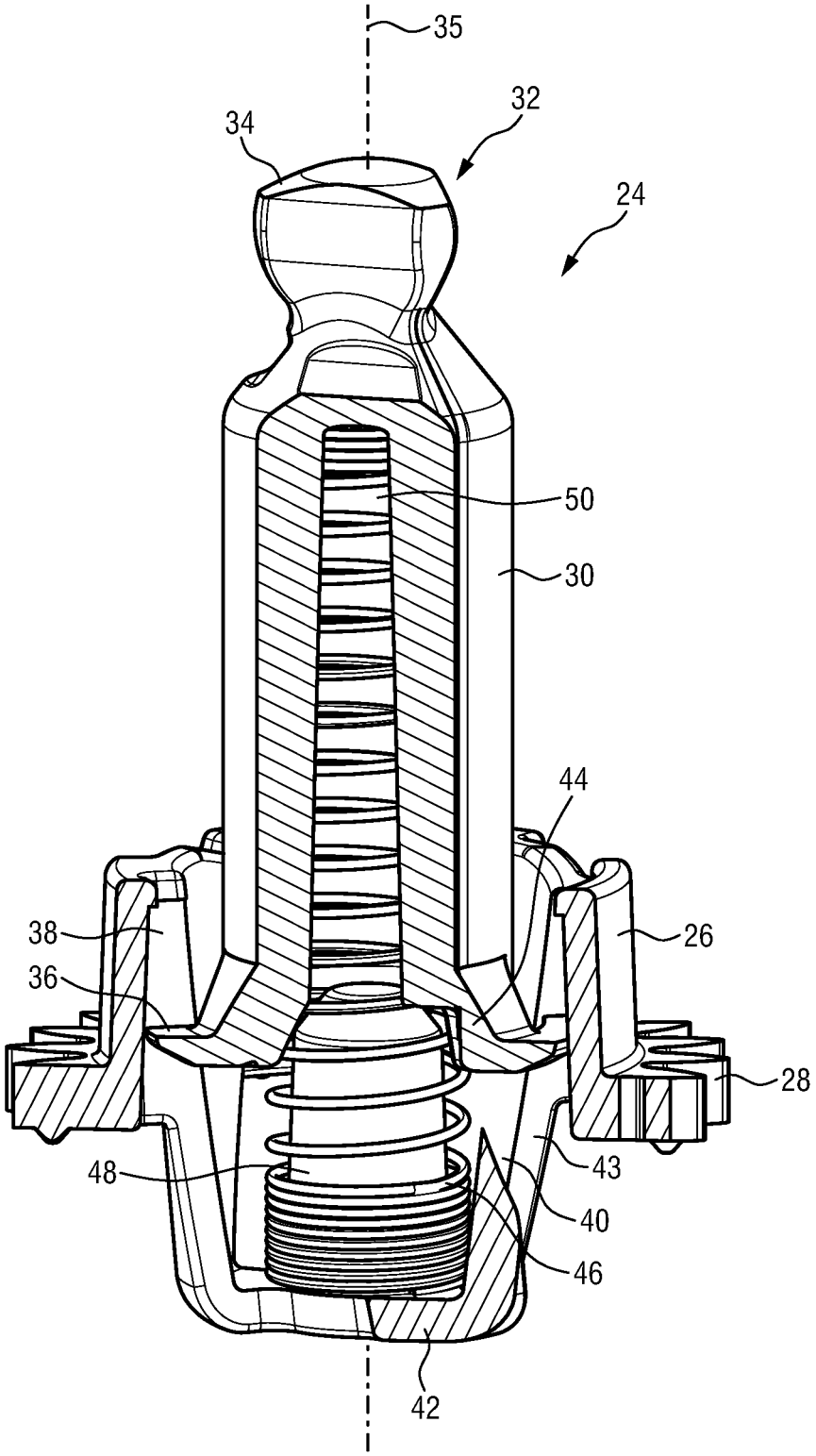
FIG. 3 shows the drive spindle of FIG. 2, shown in longitudinal section.

From FIG. 3 it can be seen that the first part 26 is of somewhat cup-like nature including a bottom 40 from which sidewalls 43 extend. The second part 30 at its lower end 44 comprises a plurality of abutment elements 36 that are configured as bosses that extend radially. These abutment elements or bosses 36 cooperate with helical abutment surfaces 38 provided on the first part 26, wherein the bosses 36 are guided.

The first part 26 and the second part 30 are pre-stressed apart from each other by a mechanical compression spring 46 configured as a helical spring that is arranged at the bottom 42 held by a mandrel 48 extending therefrom and that extends into a cylindrical cavity 50 of the second part 30.

Figure 4:
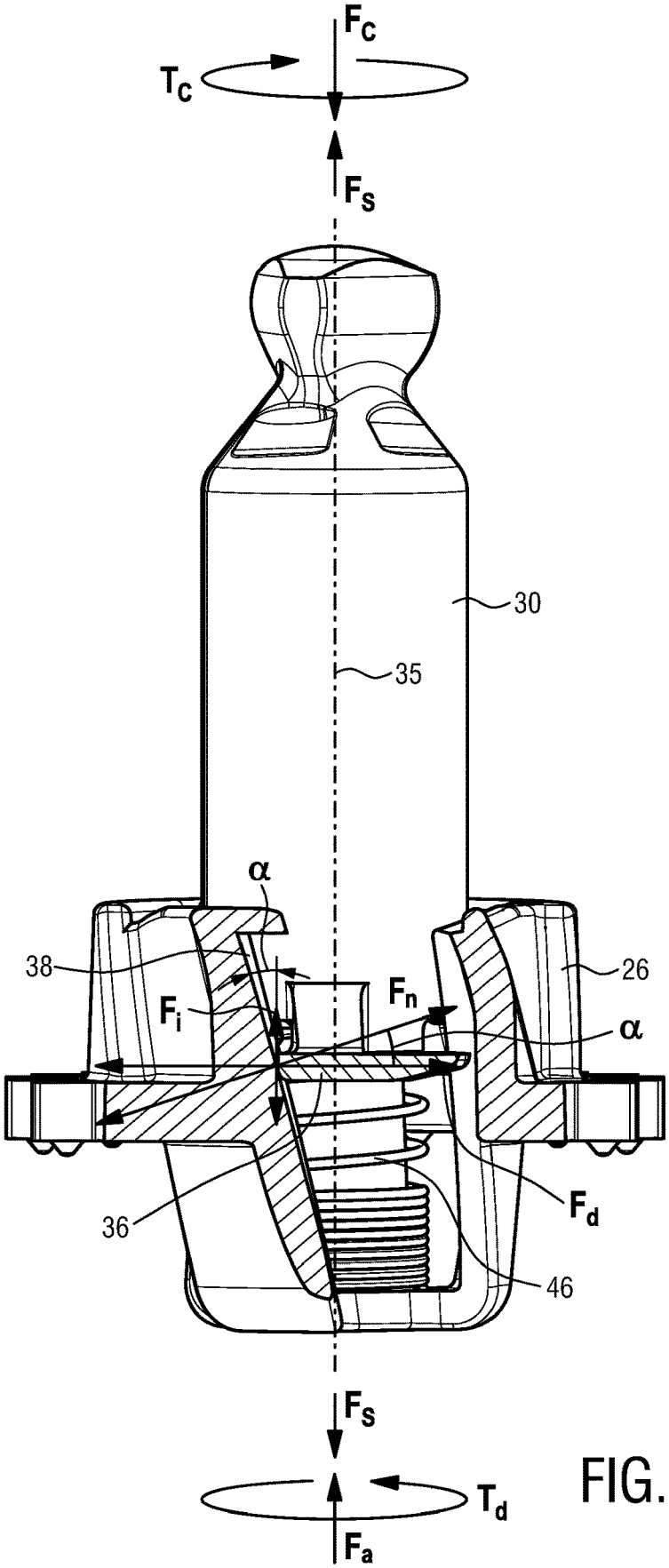
FIG. 4 shows another partially sectioned view of the drive spindle according to FIG. 2 wherein the respective forces are explained.

In FIG. 4 the forces acting during hair cutting are explained.

During hair cutting the cutting unit 17 exerts a torque Tc that is transmitted via the coupling element 34 onto the drive spindle 24. Further an axial force $F_c$ resulting from the pressure between the cutting unit 17 and the skin acts on the drive spindle 24. The respective torque Tc is equal to the torque $T_d$ acting on the drive 16 transmitted by the toothing 28. The abutment suefaces 38 or bosses are arranged at an angle $\alpha$ with respect to the axis of rotation 35 of the drive spindle 24 that is defined by the longitudinal axis.

Figure 5:
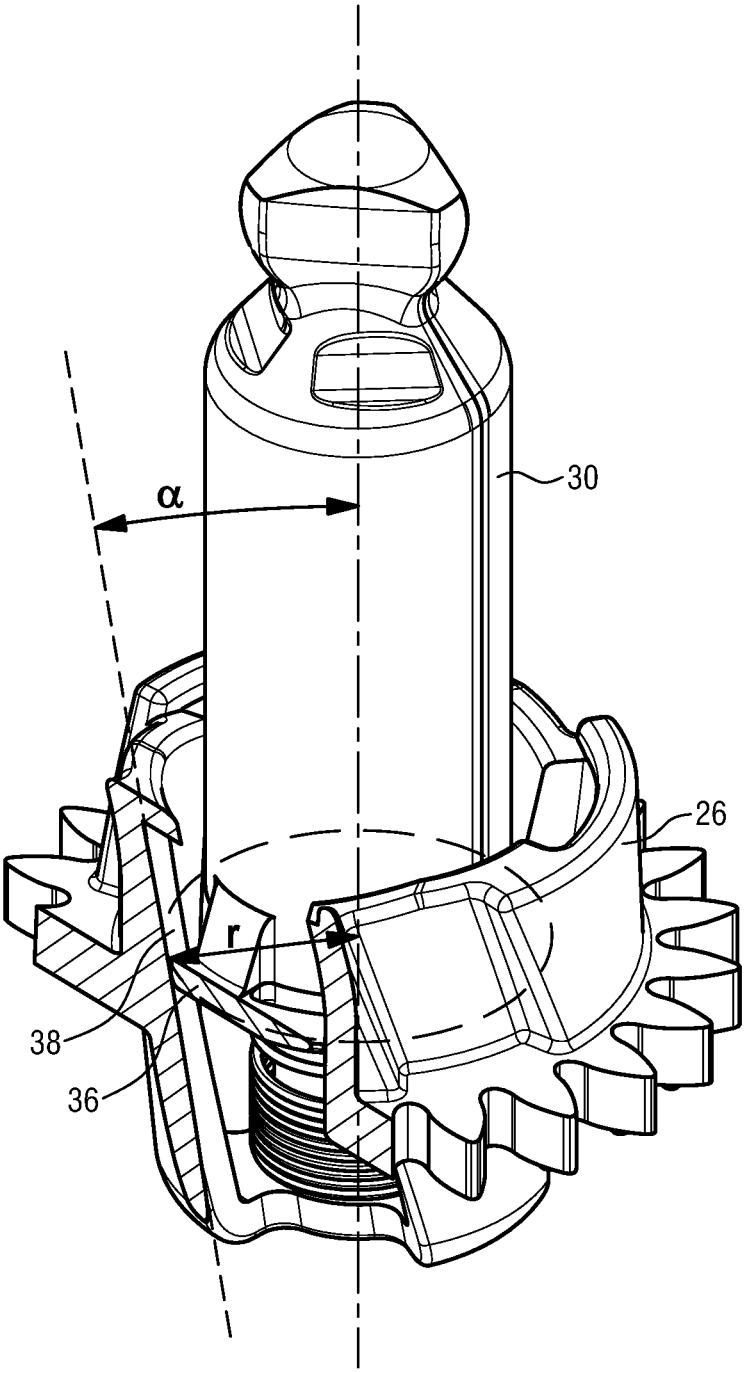
FIG. 5 shows the drive spindle of FIG. 2, shown partially sectioned for explaining the angle $\alpha$ and the radius r.
Figure 6:
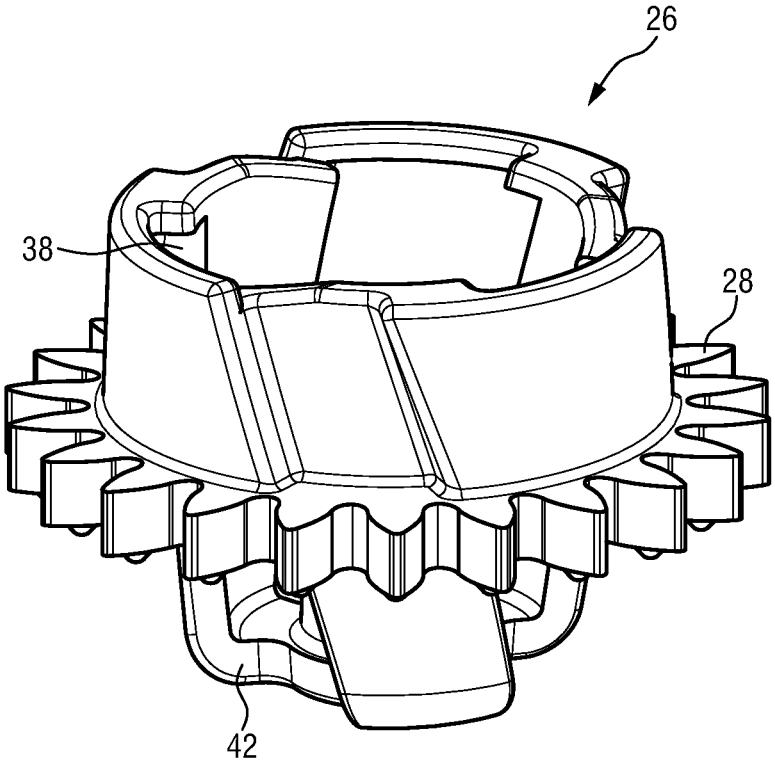
FIG. 6 shows a perspective view of a second spindle part of the drive spindle according to FIG. 2.
Figure 7:
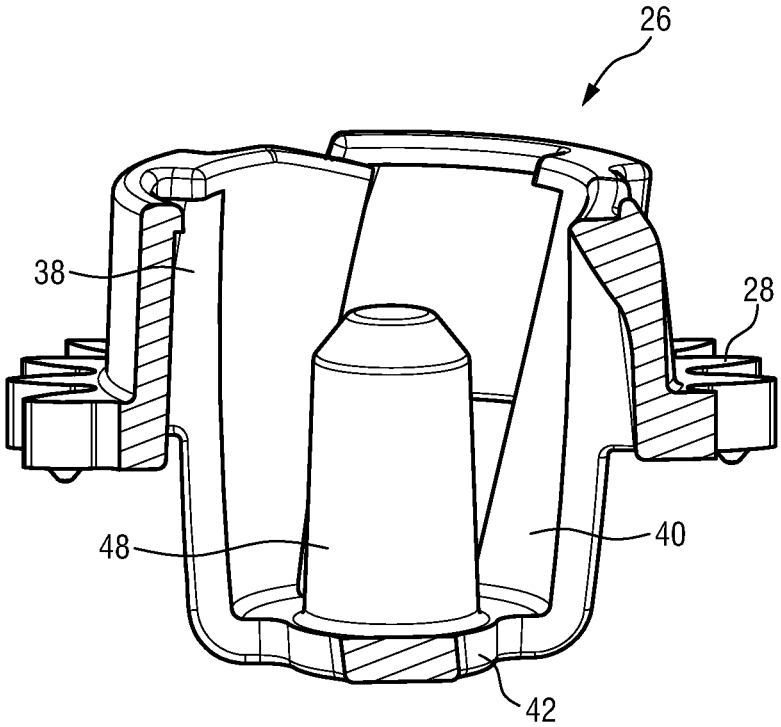
FIG. 7 shows a cross section through the second spindle part according to FIG. 6.

The angle $\alpha$ is shown in FIGS. 4 and 5. The plane, wherein the angle $\alpha$ is defined, is formed by "unwrapping" or unwinding over the cylinder of the first spindle part 30. The angle $\alpha$ is the angle between the abutment surface 38 shown in FIG. 4 and the straight line extending parallel to the axis of rotation 35.

At the contact surface between the abutment element 36 or boss and the respective abutment surface 38 the torque $T_d$ is transmitted from the first part 26 onto the second part 30.

When a torque $T_d$ is exercised on the drive spindle 24, the abutment surfaces 38 in the lower segment of the first part 26 will exercise a rotational force $F_d=T_d/r$ onto the abutment elements 36 or bosses of the second part 30. As a result of the slope (angle $\alpha$) an axial component $F_i$ is created. The axial component $F_i$ can be computed using the angle $\alpha$, the driving force $F_d$ and the resulting force $F_n$ depicted in FIG. 4.

The following relations result:

$$F_d=T_d/r$$

$$F_n=F_d/\cos\alpha$$

$$F_i=F_n\cdot\sin\alpha$$

$$F_i=F_d\cdot\tan\alpha$$

Thus it can be seen that the axial component $F_i$ is proportional to the applied torque $T_d$ and to the resulting rotational force $F_d$.

The configuration of the abutment elements 36 and the corresponding abutment surfaces 38 is selected so that there is no self-locking.

The spring 46 exerts an additional axial force $F_s$, and acts as an offset to $F_i$, Together these forces provide the closing force $F_c$ onto the cutting elements or the cutting head 14:

$$F_c=F_i+F_s.$$

The spring 46 ensures the extension of the drive spindle 24 and a minimum closing force.

Consequently, as shown above, when the cutting system encounters beard hairs, the torque $T_c$ will increase, and the closing force $F_c$ will instantaneously increase as well. With heavier beards, the torque will increase more, and the closing force accordingly. This will improve cutting performance with heavier beards, while unnecessary skin irritation with lighter beards is avoided. When the shaver is running idle, the torque will decrease, and the closing force $F_i$ will be decreased accordingly. Thereby, friction, wear, energy loss and noise are reduced, and battery life is extended.

The ratio and the torque $T_c$ and the axial force $F_i$ can be tuned by setting the angle α. The offset $F_s$ to the axial force $F_i$ can be tuned by the properties of the spring 46.

Friction forces between the second part 30 and the first part 26 have been neglected so far, since such friction forces are inherent in any kind of drive spindle consisting of two parts movable with respect to each other. The angle α should have a minimum value so that dynamic friction forces are overcome so that there will be a continuous movement of the second part 30 with respect to the first part 26 under pressure exerted by the cutting unit 17. The friction is dynamic due to the angle between the first part 26 and the second part 30. The critical minimum angle α can be derived from sin (α)=friction coefficient. The minimum angle α to overcome dynamic friction forces is estimated to be on the order of 3° to 8°.

In an alternative embodiment, the spring 46 can be omitted. In that case, the drive spindle 24 is permanently attached to the axle of the cutting unit 17. The closing force will then be exercised by the torque-induced mechanism alone. Some minimum friction should be provided to ensure a minimum torque in operation, and a closing of the cutting system.

Figure 8:
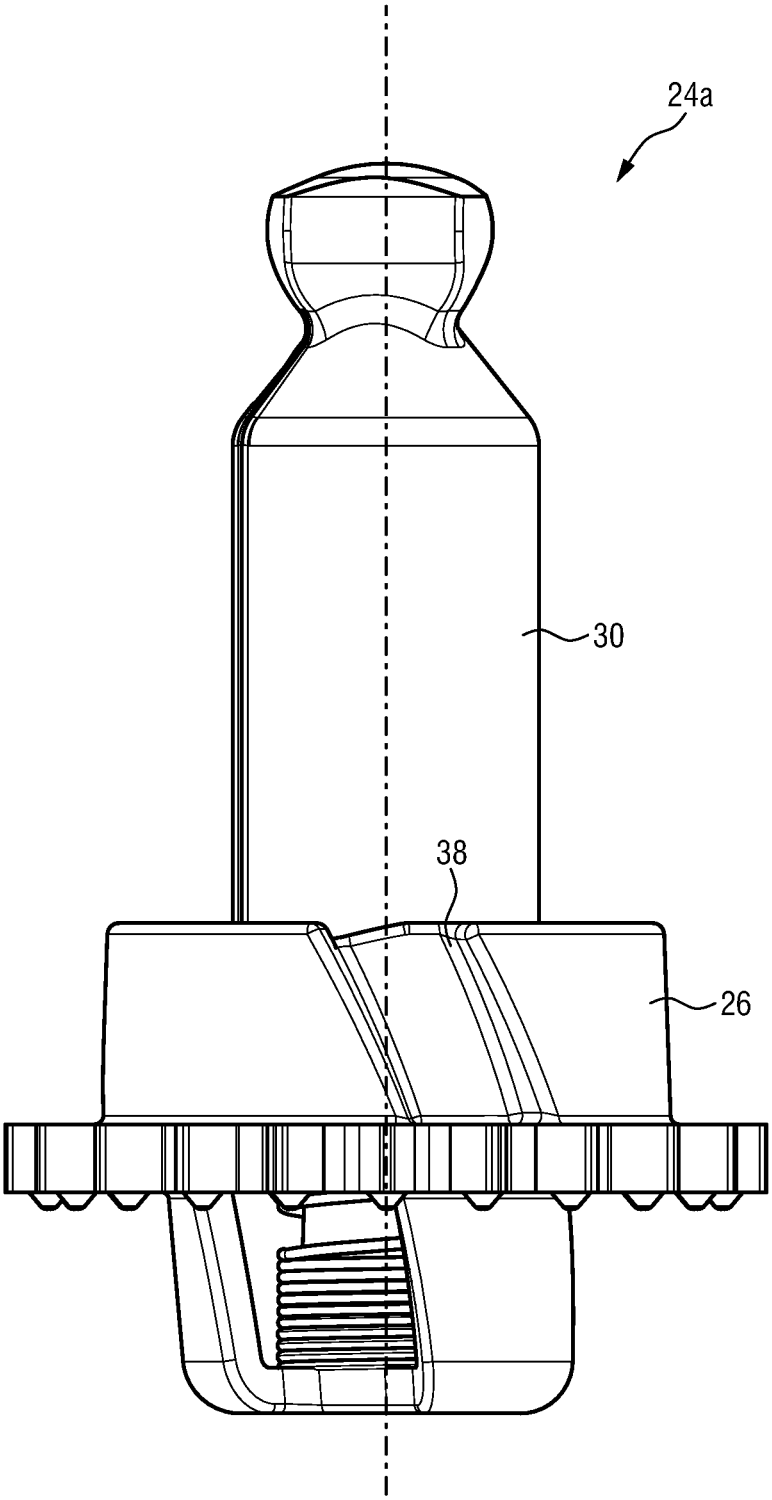
FIG. 8 shows an alternative embodiment of a drive spindle with a varying slope or angle.

In another alternative embodiment, the slope of the abutment surfaces 38 varies along the extension range of the drive spindle. Such a situation is shown in FIG. 8. The slope or angle α of the abutment surface 38 of the drive spindle 24*a* is not constant, but varies in axial direction.

Figure 9:
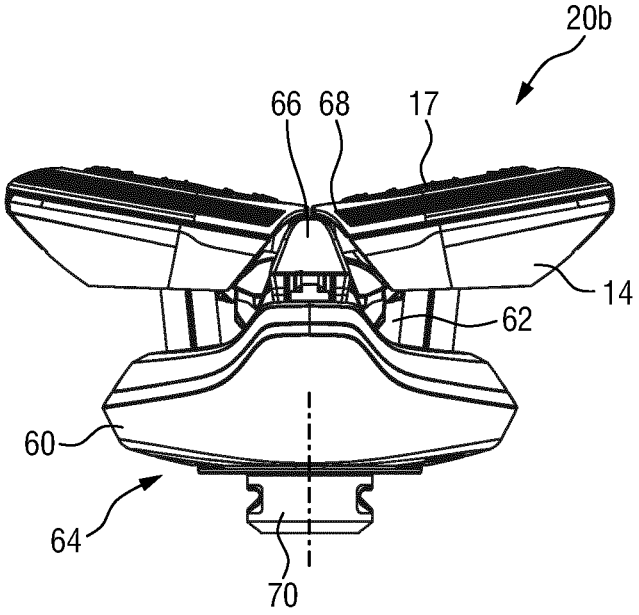
FIG. 9 shows a shaving unit including a contour following mechanism as known from PCT/EP2018/051763 in a base position.
Figure 10:
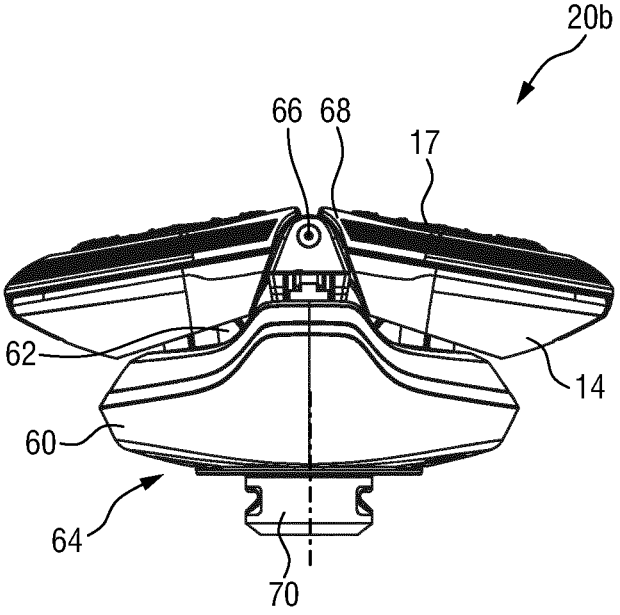
FIG. 10 shows the shaving unit of FIG. 9 in a downwardly tilted position.
Figure 11:
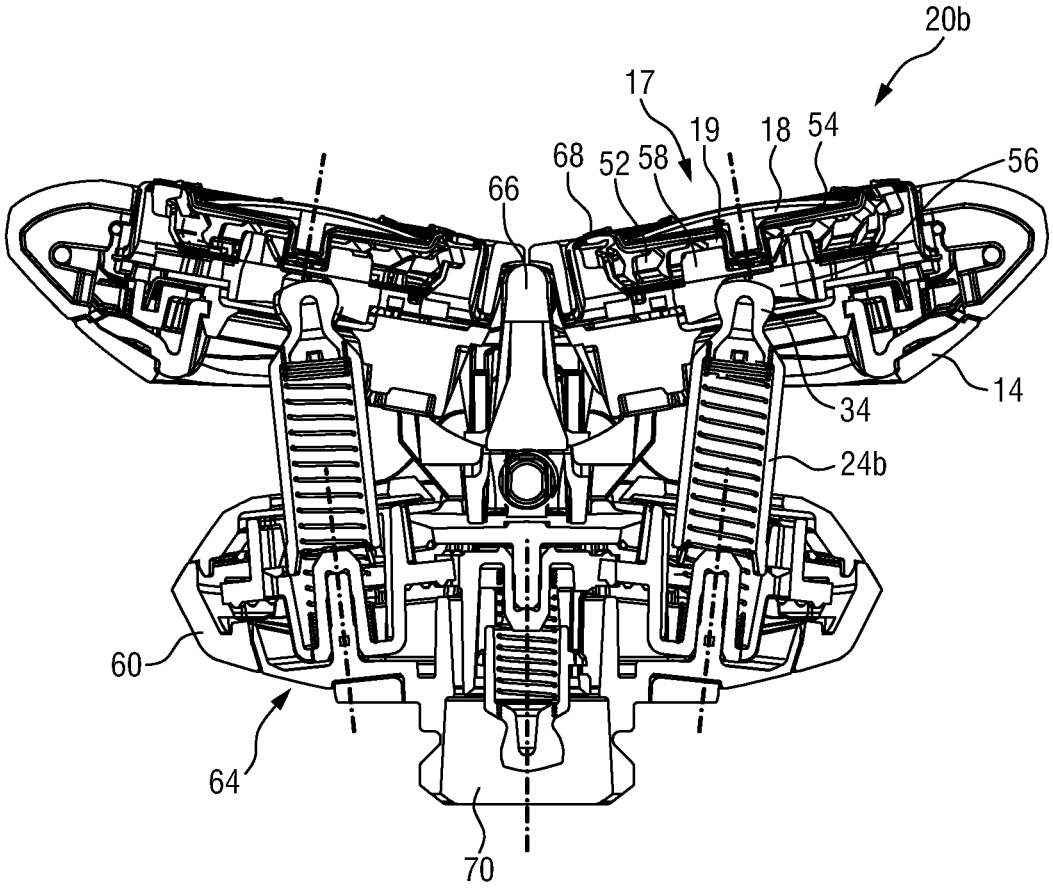
FIG. 11 shows a cross-section of the shaving unit of FIG. 9.

In FIGS. 9 to 11 a shaving unit 20*b* including a contour following mechanism is shown as known from PCT/EP2018/051763 (not published yet) which is fully incorporated by reference herewith.

Apart from the shaving unit 20*b* and the drive spindle 24*b* the same reference numbers are used for corresponding parts.

The shaving unit 20*b* includes two cutting units 17. Each cutting unit 17 comprises an external cutting member 18 having a plurality of hair entry openings 54 and an internal cutting member 19 that is arranged rotatably relative to the external cutting member 18.

The internal cutting member 19 comprises a plurality of cutting elements 52, a carrier 58 carrying the cutting elements 52 and a first coupling element 56 that engages with a second coupling element 34 for driving the internal cutting member 19 by means of the drive spindle 24*b*.

Each cutting unit 17 is movably suspended relative to a support structure 60 by means of a suspension structure 62. The suspension structure 62 comprises a pivot structure 66 that for each cutting unit 17 connects a supporting member 68, on which the cutting unit 17 is supported, pivotably to the support structure 60.

Figure 12:
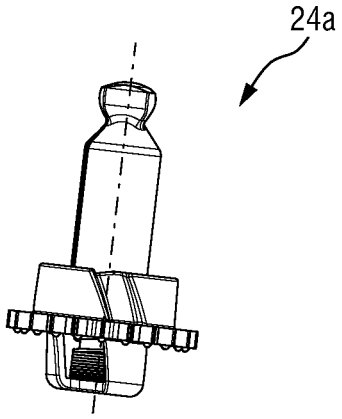
FIG. 12 shows one of the associated drive spindles according to the invention for replacing the respective drive spindle of FIG. 11.

According to the invention the drive spindles 24*b* are replaced by drive spindles 24*a* with varying slope as shown in FIG. 8 or 12.

The support structure 60, whereon the two cutting units 17 are supported, is commonly driven via an external drive or actuator that is coupled to a central coupling 70 from which the drive motion is transferred onto each drive spindle 24*a* driving each cutting unit 17.

In FIG. 9 the shaving unit 24*b* is shown in a first position, while the shaving unit 24*b* in FIG. 10 is shown in a second position, wherein the cutting units have pivoted downwardly (due to a possible contact to a skin of a user). Thus the shaving head 20*b* allows for a contour following along a user's skin.

The shaving unit 20*b* is driven by the drive spindle 24*a* via a coupling that consists of the first coupling element 56 that drives the carrier 58 for the cutting elements 52 of the internal cutting member 19, and of the second coupling element 34 provided on the drive spindle 24*a*.

When the shaving unit 20*b* performs a pivoting motion relative to the support structure 60, then at each drive spindle 24*a* the first coupling element 56 is displaced in the axial direction whereby the first and second spindle parts 26, 30 are displaced relative to each other in the axial direction, and wherein the angle α of the abutment surface 38 (see FIG. 8) varies in the axial direction.

In the downwardly tilted position according to FIG. 10 the drive spindles 24*a* are shortened, i.e. the second part 30 of the drive spindle 24*a* is more downward than in the lifted position of the shaving unit 20*b* shown in FIG. 9.

Since the slope or angle α of the abutment surface 38 of the drive spindle 24*a* at the upper section thereof is greater than at the lower section, the relationship between the torque and the closing force is varied by the position of the shaving unit 20*b* with respect to the drive spindle 24*a*.

While the invention has been illustrated and described in detail in the drawings and foregoing description, such illustration and description are to be considered illustrative or exemplary and not restrictive; the invention is not limited to the disclosed embodiments. Other variations to the disclosed embodiments can be understood and effected by those skilled in the art in practicing the claimed invention, from a study of the drawings, the disclosure, and the appended claims.

In the claims, the word "comprising" does not exclude other elements or steps, and the indefinite article "a" or "an" does not exclude a plurality. A single element or other unit may fulfill the functions of several items recited in the claims. The mere fact that certain measures are recited in mutually different dependent claims does not indicate that a combination of these measures cannot be used to advantage.

Any reference signs in the claims should not be construed as limiting the scope.

The invention claimed is:

1. A hair cutting appliance comprising:

a support structure accommodating a drive system;

at least one cutting unit supported by the support structure and comprising an external cutting member having a plurality of hair entry openings, and an internal cutting member rotatable relative to the external cutting member; and at least one drive spindle rotatable about an axis of rotation and having a first spindle part arranged to be driven by the drive system and a second spindle part arranged to be coupled to the internal cutting member, the first and second spindle parts being displaceable relative to each other in an axial direction parallel to the axis of rotation;

wherein the internal cutting member comprises a plurality of cutting elements, a first coupling element, and a carrier carrying the cutting elements and the first coupling element;

wherein the second spindle part comprises a second coupling element which is coupled to the first coupling element for transmitting, during operation, a driving torque about the axis of rotation from the drive spindle to the internal cutting member; and wherein one of the first and second spindle parts comprises an abutment element and the other of the first and second spindle parts comprises an abutment surface arranged to cooperate with the abutment element for transmitting, during operation, the driving torque from the first spindle part to the second spindle part;

characterized in that the abutment surface is arranged at an angle $\alpha$ relative to a line extending parallel to the axis of rotation, wherein $0°<\alpha<90°$ such that a transmission of the driving torque from the first spindle part to the second spindle part via the abutment element and the abutment surface results in a force exerted by the first spindle part on the second spindle part having a component parallel to the axis of rotation and directed towards the internal cutting member, wherein the first and second coupling elements are configured to transmit said component from the second spindle part to the internal cutting member.

2. The hair cutting appliance as claimed in claim 1, characterized in that the abutment surface extends helically relative to the axis of rotation.

3. The hair cutting appliance of claim 1, characterized in that the abutment element comprises a boss.

4. The hair cutting appliance as claimed in any one of the claim 1, characterized in that the drive spindle comprises a mechanical spring arranged to bias the second spindle part relative to the first spindle part in a direction towards the internal cutting member.

5. The hair cutting appliance as claimed in claim 1, characterized in that the first spindle part comprises a cavity, wherein the second spindle part is partially received in said cavity and displaceably guided by said cavity so as to be displaceable relative to the first spindle part in the axial direction.

6. The hair cutting appliance as claimed in claim 5, characterized in that the mechanical spring is arranged in said cavity for exerting a biasing force on the second spindle part directed towards the internal cutting member.

7. The hair cutting appliance as claimed in claim 1, characterized in that the angle ($\alpha$) is at least 3°, preferably at least 5°, preferably at least 20°.

8. The hair cutting appliance as claimed in claim 1, characterized in that the angle ($\alpha$) is at most 87°, preferably at most 85°, preferably at most 70°.

9. The hair cutting appliance as claimed in claim 1, characterized in that the cutting unit is moveably suspended relative to the support structure by means of a suspension structure such that, as a result of a motion of the cutting unit relative to the support structure allowed by the suspension structure, the first coupling element is displaced in the axial direction whereby the first and second spindle parts are displaced relative to each other in the axial direction, and wherein the angle ($\alpha$) of the abutment surface varies in the axial direction.

10. The hair cutting appliance as claimed in claim 9, characterized in that the cutting unit comprises a supporting member for supporting the external cutting member, and wherein the suspension structure comprises a pivot structure pivotally connecting the supporting member to the support structure.

11. The hair cutting appliance as claimed in claim 9, further characterized by at least two cutting units and at least two drive spindles, wherein each of the at least two drive spindles is arranged to be couplable to a respective one of the at least two cutting units.

12. The hair cutting appliance as claimed in claim 9, characterized in that the second coupling element is releasably coupleable to the first coupling element.

13. A hair cutting device comprising a main housing accommodating an actuator, and further comprising a hair cutting appliance as claimed in claim 9, wherein the support structure is releasably coupled to the main housing, and wherein the actuator is arranged to drive the drive system during operation of the hair cutting device when the hair cutting appliance is coupled to the main housing.

* * * * *